US005433089A

United States Patent [19]

Timbal

[11] Patent Number: 5,433,089

[45] Date of Patent: Jul. 18, 1995

[54] CONVERTIBLE EARRING CLASP

[76] Inventor: Christine M. Timbal, 1355 S. Perris. Blvd., L-79, Perris, Calif. 92570

[21] Appl. No.: 154,214

[22] Filed: Nov. 17, 1993

[51] Int. Cl.[6] ..... A44C 7/00

[52] U.S. Cl. ..... 63/12; 63/14.4

[58] Field of Search ..... 63/12, 14.1, 14.2, 14.4, 63/14.5, 1.1

[56] References Cited

U.S. PATENT DOCUMENTS

| | | | |
|---|---|---|---|
| 271,121 | 1/1883 | Riley | 63/12 |
| 360,423 | 4/1887 | Edge | 63/12 |
| 2,501,754 | 3/1950 | Battiste | 63/14.5 |
| 2,564,435 | 8/1951 | Hubbell | 63/14.4 |
| 2,813,407 | 11/1957 | Arzt | 63/14.5 |
| 4,003,216 | 6/1977 | Cecere | 63/12 |
| 5,048,311 | 9/1991 | Mastrobuono | 63/12 |

FOREIGN PATENT DOCUMENTS

| | | | |
|---|---|---|---|
| 1166757 | 11/1958 | France | 63/14.5 |

*Primary Examiner*—Flemming Saether
*Attorney, Agent, or Firm*—Waters & Morse

[57] ABSTRACT

This earring clasp has a platform and a pivoted clamping member with a conventional biasing system providing gentle clamping action against the platform for grasping the ear lobe. A post for engaging a pierced ear is pivoted to the platform for movement between a position flat against the platform to an erect perpendicular position. The clamping member closes over the end of the post to shield it and retain the ear lobe.

3 Claims, 2 Drawing Sheets

CONVERTIBLE EARRING CLASP

RELATED FIELD

This invention is related to the construction of earring clasps.

BACKGROUND OF THE INVENTION

The construction of an earring clasp should allow for the fact that some wearers have pierced ears, and some do not. It is common practice to provide a clamping member pivoted to a platform in such a way as to clamp the lobe of the ear gently between them. Even when a post is provided for engaging a pierced ear lobe, a retainer of some sort must be present to hold the ear lobe in engagement with the post. This leaves the projected end of the post in a position to poke into the neck of the wearer, which can be painful in the event of accidental contact of the ear against something solid and unyielding. Some post-type earring clasps are provided with a form of cap to be fitted over the end of the post on the inside of the ear lobe, but such an arrangement invites the misplacement of the tiny cap, and requires some degree of skillful manipulation. An arrangement of this type is shown in the U.S. Pat. No. 5,048,311 (FIG. 2). This patent shows a removable post for accommodating use as a purely clamp-type system, which involves a multiplicity of small and easily misplaced components.

SUMMARY OF THE INVENTION

This invention provides for a retractable post pivoted to one side of a clasp, and adapted to move from a retracted position flat against that part of the clasp to an erected position extending perpendicularly to it. The opposite side of the biased clasp can close over the end of the erected post to maintain engagement with the ear lobe. Preferably, the end of the post is received in an indentation for assuring alignment and shielding of the post end. The clasp may be otherwise conventional, including a platform and a biased clamping member as the two sides of the clasp.

DESCRIPTION OF THE PREFERRED EMBODIMENT

Figure 6:
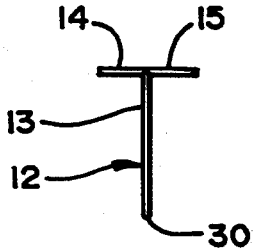
FIG. 6 is a plan view of the T-shaped post.
Figure 7:
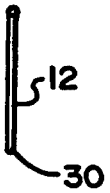
FIG. 7 is a side elevation with respect to FIG. 6.
Figure 8:
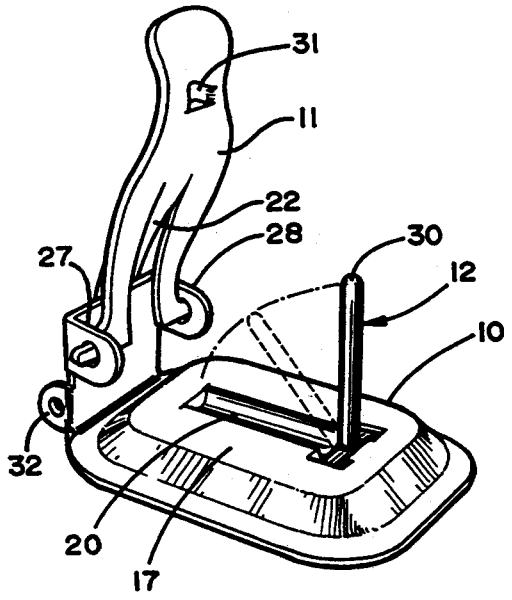
FIG. 8 is a perspective view showing the open position of the clasp, with the post in the erected position.
Figure 9:
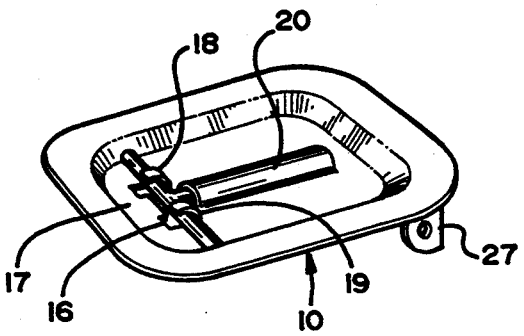
FIG. 9 is a view of the underside of the clasp, showing the retracted position of the post. A clamping member is not present in FIG. 9.

Referring first to FIG. 8, the illustrated clasp assembly includes the platform 10, the pivoted clamping member 11, and the retractable post 12. The post 12 has a T-shaped configuration formed by the arm 13 extending radially from the cross member providing the opposite coaxial journal portions 14 and 15, as shown in FIG. 6. In the assembly of the post 12 to the platform 10, the arm 13 is first poked through the opening 16 in the platform, and this movement is continued until the journal portions 14 and 15 overlay portions of the underside of the planar central area 17 of the platform. When in this position, tabs as shown at 18 and 19, which are bent from the material of the planar section 17 in the course of the formation of the opening 16, are closed over the journals 14 and 15 to provide a pivotal mounting for the post. The deformed tabs 18 and 19, together with the overlapped portions of the planar section 17, thus form a bearing for the post in its rotation from the retracted position against the platform to the erected position shown in FIG. 8. In the retracted position, in which the post lies flat against the platform, it is received within a formed recess 20 in the planar portion 17 to shield the arm 13 from lateral forces which might disturb its position.

Figure 1:
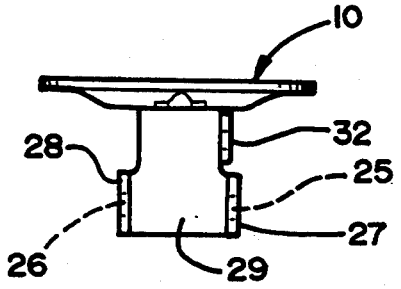
FIG. 1 is an end. view of the platform of the device.
Figure 2:
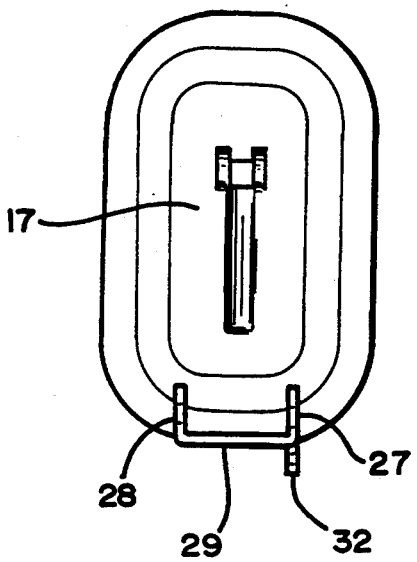
FIG. 2 is a plan view of the platform shown in FIG. 1.
Figure 3:
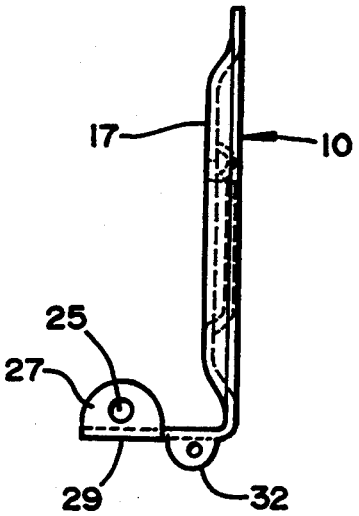
FIG. 3 is a side elevation with respect to FIG. 2.
Figure 4:
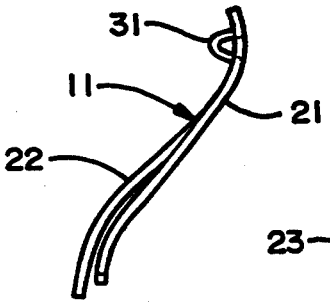
FIG. 4 is a side elevation of the clamping member.
Figure 5:
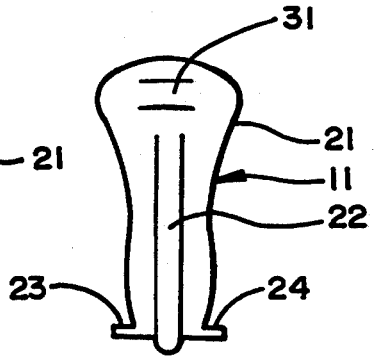
FIG. 5 is a front view of the clamping member shown in FIG. 4.

The clamping member 11 is shown in greater detail in FIGS. 4 and 5. A body portion 21 has a leaf spring 22 lanced from the original sheet material of the body portion. The oppositely-extending journals 23 and 24 on the body portion 21 interengage with the holes 25 and 26 in the tabs 27 and 28 of the platform. In the assembly of the clamping member to the platform, the central portion 29 between the tabs 27 and 28 is interposed between the leaf spring 22 and the body portion 21. This arrangement provides a biasing action in the closed position of the clamping member due to the downward force along the top edge of the central portion 29, which is laterally displaced from the center of the pivot provided by the journals 23 and 24. This arrangement is conventional. In the closed position, with the post 12 erected as shown in FIG. 8, the outer end of the post 30 is received within the indentation provided by the lanced portion 31 in the clamping member. This effectively shields the end 30, and prevents it from poking into the neck of the wearer. After the wearer has attached the clasp to the lobe of the ear by inserting the arm 13 through the piercing (where this is present), the closure of the clasp 11 over the end 30 will maintain the engagement of the clasp with the ear. The tab 32 is provided on the platform for the attachment of whatever ornament may be desired.

I claim:

1. An earring clasp having a platform and a clamping member pivotally mounted on said platform, and adapted to clamp the lobe of an.ear between said clamping member and platform, wherein the improvement comprises:

a post pivotally mounted on said platform at a position remote from said pivotal mounting of said clamping member for movement between (a) a retracted position parallel to and against said platform, and (b) an erect position substantially perpendicular to said platform, said clamping member being adapted to close over said post in said retracted position, said post being adapted to rotate to said retracted position toward said clamping member pivotal mountina.

2. An earring clasp as defined in claim 1, wherein said clamping member has a portion disposed to bear against the end of said post on closure of said clamping member over said post in said erect position.

3. An earring clasp as defined in claim 2, wherein said clamping member has a recess adapted to receive said end.

* * * * *